US008138686B2

(12) United States Patent
Lin et al.

(10) Patent No.: US 8,138,686 B2
(45) Date of Patent: Mar. 20, 2012

(54) CURRENT REGULATOR AND METHOD FOR EFFICIENCY IMPROVEMENT OF A LED DISPLAY SYSTEM

(75) Inventors: Shui-Mu Lin, Longjing Township, Taichung County (TW); Tsung-Wei Huang, Taipei (TW); Jien-Sheng Chen, Toufen Town (TW)

(73) Assignee: Richtek Technology Corp., Hsinchu (TW)

( * ) Notice: Subject to any disclaimer, the term of this patent is extended or adjusted under 35 U.S.C. 154(b) by 330 days.

(21) Appl. No.: 12/588,702

(22) Filed: Oct. 26, 2009

(65) Prior Publication Data

US 2010/0102731 A1 Apr. 29, 2010

(30) Foreign Application Priority Data

Oct. 29, 2008 (TW) ..... 97141587 A

(51) Int. Cl.
*H05B 37/02* (2006.01)

(52) U.S. Cl. ..... 315/291; 315/160; 315/294; 315/295; 315/307; 315/308; 345/77; 345/204; 327/108; 327/132; 327/333

(58) Field of Classification Search ..... 315/160, 315/209 R, 224–226, 291, 294, 295, 297, 315/307, 308, 312; 345/77, 204; 327/108, 327/132, 333

See application file for complete search history.

(56) References Cited

U.S. PATENT DOCUMENTS

| | | | | |
|---|---|---|---|---|
| 5,285,148 | A * | 2/1994 | Uhlenhoff et al. | 323/272 |
| 7,304,871 | B2 * | 12/2007 | Ito et al. | 363/59 |
| 2005/0083110 | A1 * | 4/2005 | Latham et al. | 327/538 |
| 2005/0128168 | A1 * | 6/2005 | D'Angelo | 345/82 |
| 2006/0028150 | A1 * | 2/2006 | Vitunic et al. | 315/248 |
| 2006/0055465 | A1 * | 3/2006 | Lin et al. | 330/288 |
| 2006/0109025 | A1 * | 5/2006 | Tomita | 324/770 |
| 2007/0069712 | A1 * | 3/2007 | Kamatani | 323/315 |
| 2007/0205823 | A1 * | 9/2007 | Cho | 327/536 |
| 2008/0042729 | A1 * | 2/2008 | Huang et al. | 327/536 |
| 2008/0068066 | A1 * | 3/2008 | Mittal | 327/535 |

* cited by examiner

*Primary Examiner* — Douglas W Owens
*Assistant Examiner* — Thai Pham
(74) *Attorney, Agent, or Firm* — Rosenberg, Klein & Lee

(57) ABSTRACT

For efficiency improvement of a LED display system including a charge pump and a LED connected to either the voltage input terminal or the voltage output terminal of the charge pump, either one or both of two current regulators are enabled according to a voltage detected from the LED, for establishing a driving current for the LED. When the detected voltage is higher than a threshold, the first one of the current sources is enabled sole. When the detected voltage is lower than the threshold, the second one of the current sources is enabled sole, or both the current sources are enabled, or the current sources are alternatively enabled.

22 Claims, 11 Drawing Sheets

CURRENT REGULATOR AND METHOD FOR EFFICIENCY IMPROVEMENT OF A LED DISPLAY SYSTEM

FIELD OF THE INVENTION

The present invention is related generally to a Light Emitting Diode (LED) display system and, more particularly, to a current regulator for a LED display system.

BACKGROUND OF THE INVENTION

FIG. 1 is a circuit diagram of a conventional LED display system 10, in which a charge pump 12 is configured to convert an input voltage VIN into an output voltage VOUT supplied for LEDs D1 to DN, each of the LEDs D1-DN is connected with a respective current regulator 16 to control the driving current ILEDj (j=1, . . . , N) thereof, the current regulator 16 includes an operational amplifier 18 having two input terminals connected to nodes N1 and N2 respectively, a transistors M1 connected between the node N1 and a ground terminal GND to receive a reference current IREFj (j=1, . . . , N), and a transistors M2 connected between the node N2 and the ground terminal GND to establish the driving current ILEDj it controls, the operational amplifier 18 has an output terminal connected to the gates of the transistors M1 and M2 and maintains the voltages at the nodes N1 and N2 to be substantially equal to each other, so that the driving current ILEDj will reflect the reference current IREFj in proportion, depending on the size ratio of the transistors M2 to M1, and a mode decision circuit 14 is configured to detect the voltages VDS1 to VDSN at the nodes N2 of all the current regulators 16 to determine an operation mode of the charge pump 12.

FIG. 2 is a diagram showing a relationship between the input voltage VIN and efficiency of the LED display system 10. As shown in FIG. 2, the LED display system 10 has the highest efficiency when it operates in a mode x1. When the input voltage VIN decreases such that the mode decision circuit 14 detects the voltage at the node N2 of anyone of the current regulators 16 lower than a threshold, the mode decision circuit 14 signals the charge pump 12 to switch from the mode x1 to a higher mode x1.5. Actually, the LEDs D1-DN will not have a same forward voltage and therefore when the voltage at the node N2 of one of the current regulators 16 is lower than the threshold, the voltages at the nodes N2 of the other current regulators 16 may not be lower than the threshold. In other words, some of the current regulators 16 may still be capable of operating normally in the mode x1. In this case, if the charge pump 12 switches from the mode x1 to the mode x1.5, the LED display system 10 will have efficiency loss.

Therefore, it is desired a circuit and method for efficiency improvement of a LED display system.

SUMMARY OF THE INVENTION

An object of the present invention is to provide a current regulator and method for efficiency improvement of a LED display system.

According to the present invention, a LED display system includes a charge pump, a LED connected between a voltage input terminal of the charge pump and a node, and a current regulator including a first current source connected between the node and a ground terminal, a second current source connected between the node and a voltage output terminal of the charge pump, and a mode decision circuit connected to the first and second current sources to enable at least one of the first and second current sources for establishing a driving current for the LED.

According to the present invention, a LED display system includes a charge pump, a LED connected between a ground terminal and a node, and a current regulator including a first current source connected between the node and a voltage input terminal of the charge pump, a second current source connected between the node and a voltage output terminal of the charge pump, and a mode decision circuit connected to the first and second current sources to enable at least one of the first and second current sources for establishing a driving current for the LED.

According to the present invention, a method for efficiency improvement of a LED display system including a charge pump and a LED connected between a voltage input terminal of the charge pump and a node comprises detecting a voltage at the node and according thereto, enabling at least one of a first current source connected between the node and a ground terminal and a second current source connected between the node and a voltage output terminal of the charge pump, for establishing a driving current for the LED.

According to the present invention, a method for efficiency improvement of a LED display system including a charge pump and a LED connected between a node and a ground terminal comprises detecting a voltage at the node and according thereto, enabling at least one of a first current source connected between a voltage input terminal of the charge pump and the node and a second current source connected between a voltage output terminal of the charge pump, for establishing a driving current for the LED.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAIL DESCRIPTION OF THE INVENTION

Figure 1:
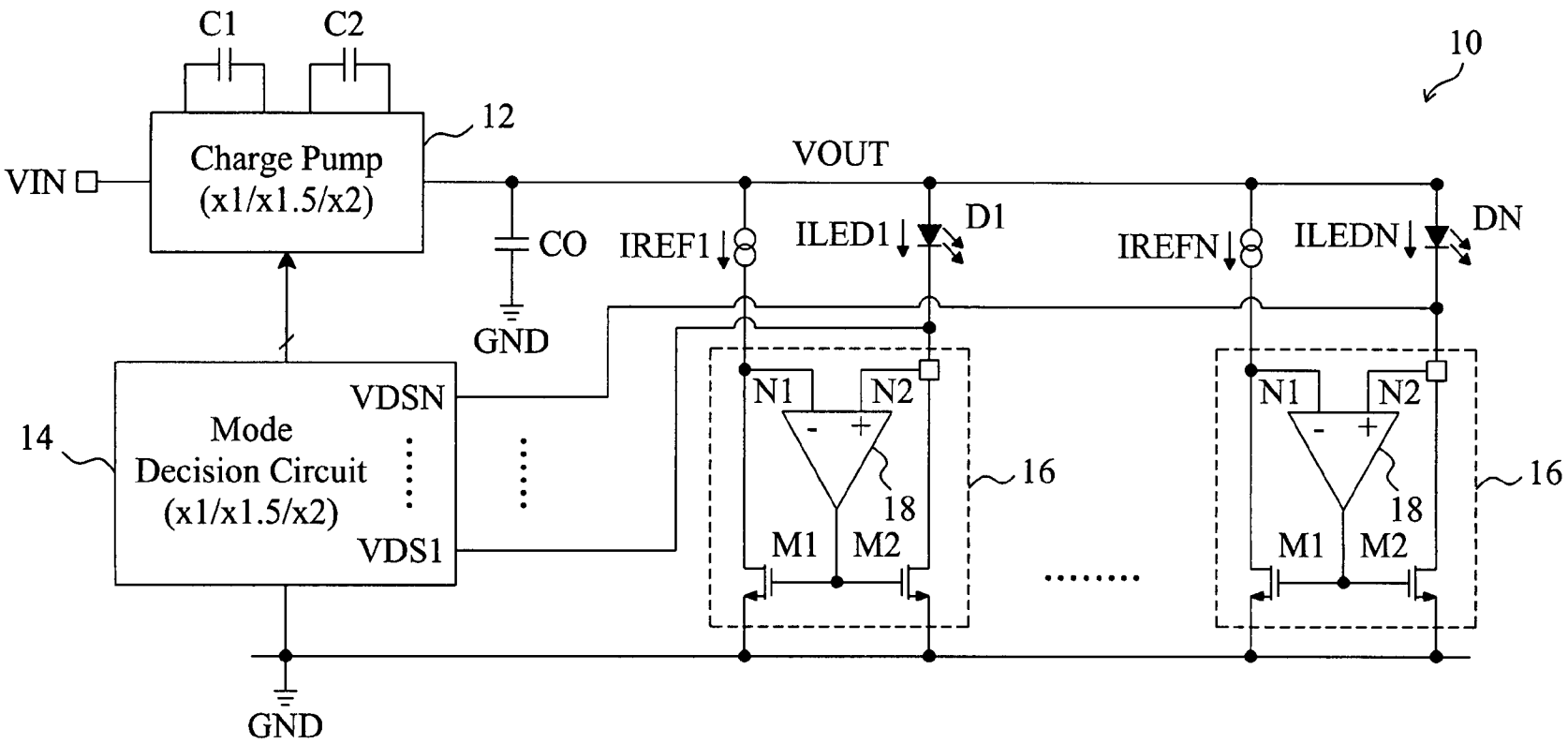
Fig. 1 Prior Art
FIG. 1 is a circuit diagram of a conventional LED display system.
Figure 2:
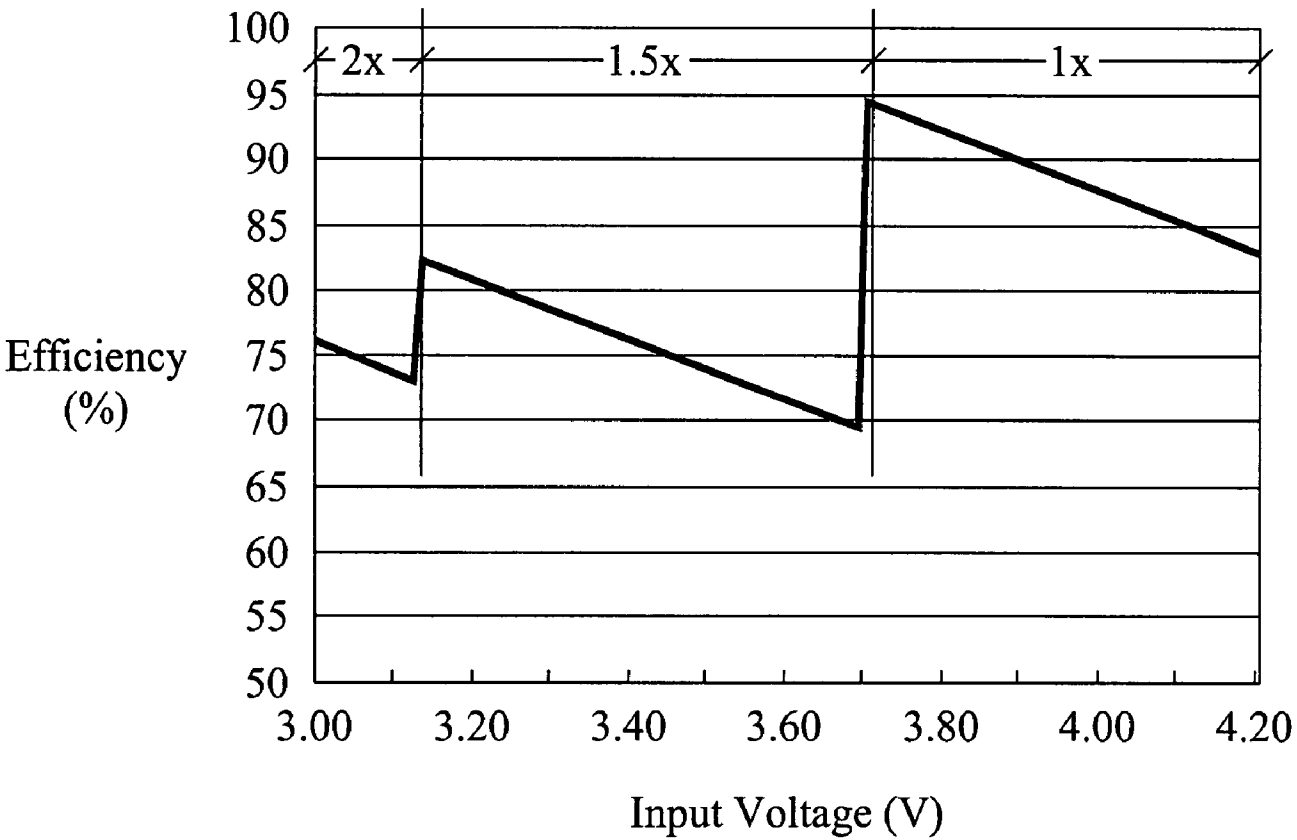
Fig. 2 Prior Art
FIG. 2 is a diagram showing the relationship between the input voltage and efficiency of the LED display system shown in FIG. 1.
Figure 3:
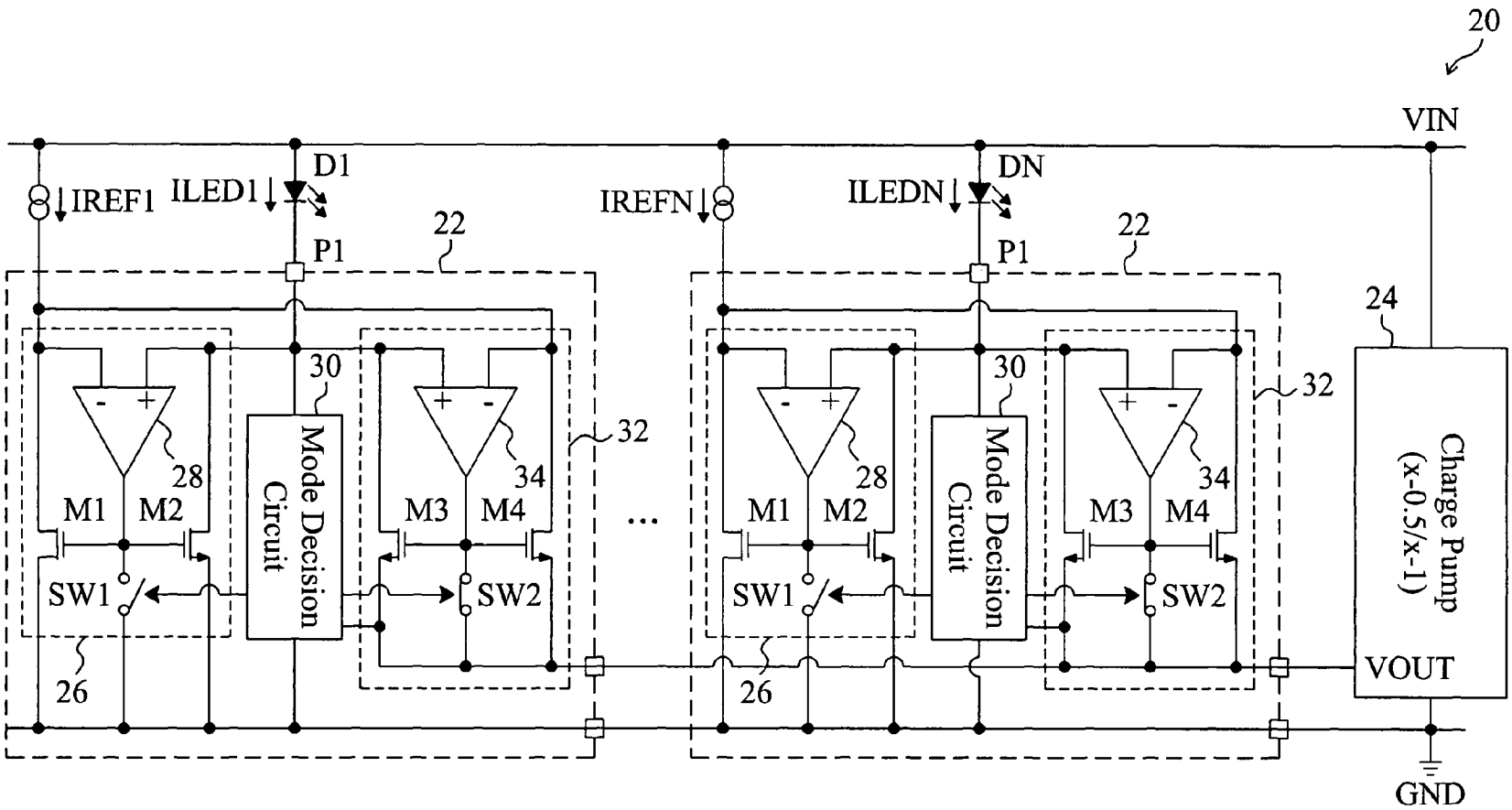
FIG. 3 is a circuit diagram of an embodiment according to the present invention.

FIG. 3 is a circuit diagram of an embodiment according to the present invention. In a LED display system 20, a charge pump 24 which can operate in either a mode x-0.5 or a mode x-1 is configured to convert an input voltage VIN into an output voltage VOUT, and several current regulators 22 provide driving currents ILED1-ILEDN for LEDs D1-DN respectively. In each of the current regulators 22, a current source 26 is connected between a node P1 and a ground terminal GND, a current source 32 is connected between the node P1 and a voltage output terminal VOUT of the charge pump 24, and a mode decision circuit 30 detects the voltage on the node P1 to determine whether to enable the current sources 26 and 32. The current source 26 includes an operational amplifier 28, transistors M1 and M2, and a switch SW1. The transistor M1 is connected between an inverting input terminal of the operational amplifier 28 and the ground terminal GND, and the transistor M2 is connected between the node P1 and the ground terminal GND. The operational amplifier 28 has a non-inverting input terminal connected to the node P1, and an output terminal connected to the gates of the transistors M1 and M2, and the switch SW1 is connected between the output terminal of the operational amplifier 28 and the ground terminal GND and is controlled by the mode decision circuit 30. The current source 32 includes an operational amplifier 34, transistors M3 and M4, and a switch SW2. The transistor M3 is connected between the node P1 and the voltage output terminal VOUT of the charge pump 24, and the transistor M4 is connected between an inverting input terminal of the operational amplifier 34 and the voltage output terminal VOUT of the charge pump 24. The operational amplifier 34 has a non-inverting input terminal connected to the node P1, and an output terminal connected to the gates of the transistors M3 and M4, and the switch SW2 is connected between the output terminal of the operational amplifier 34 and the voltage output terminal VOUT of the charge pump 24 and is controlled by the mode decision circuit 30. Since the input voltage VIN is directly applied to the LEDs D1-DN, the charge pump 24 does not need a mode x1 and as a result, the number of required components, e.g. resistors, is reduced.

Figure 4:
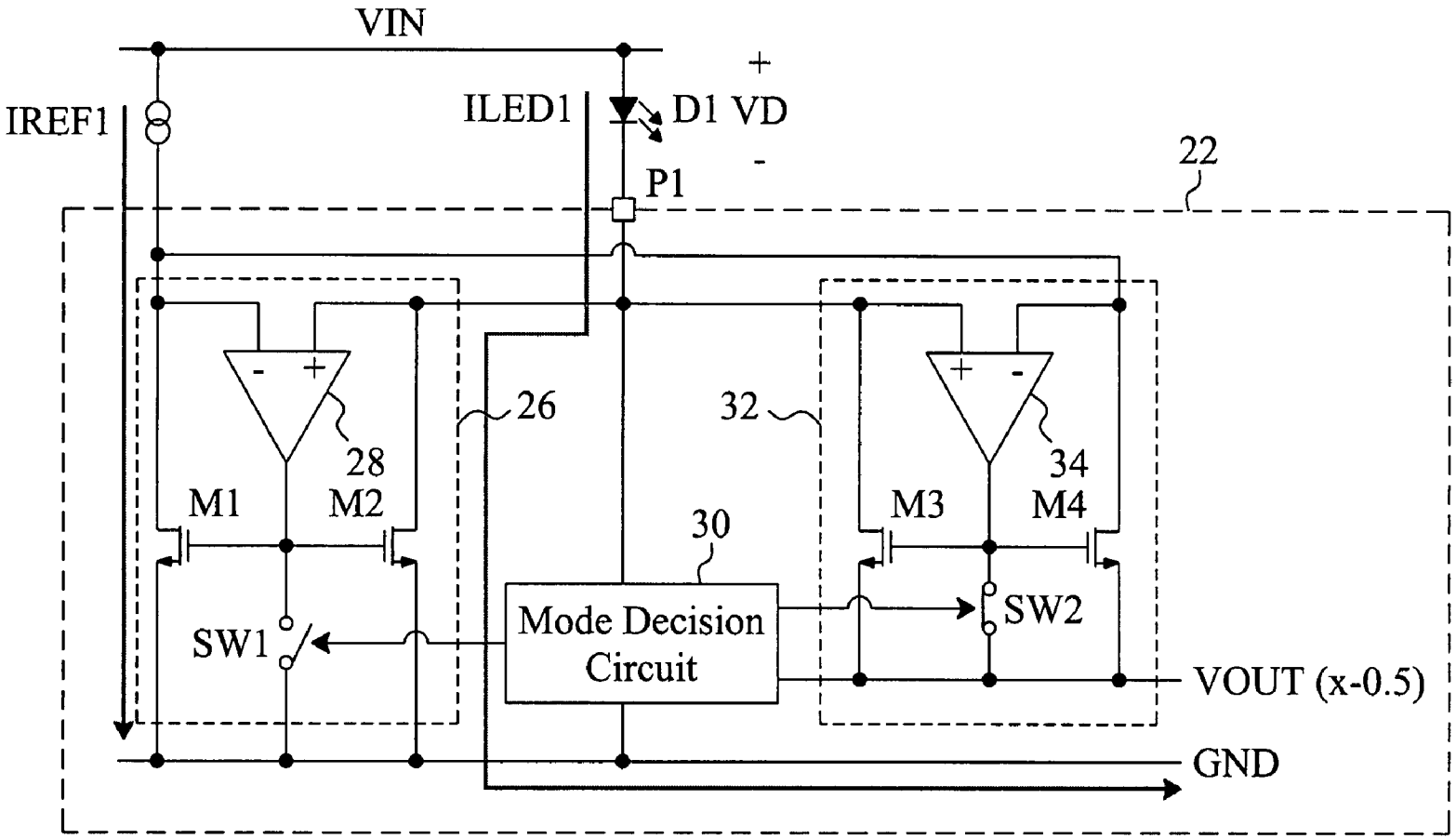
FIG. 4 is a diagram showing the operation of a first embodiment for the current regulator shown in FIG. 3 when the input voltage is higher than a threshold.
Figure 5:
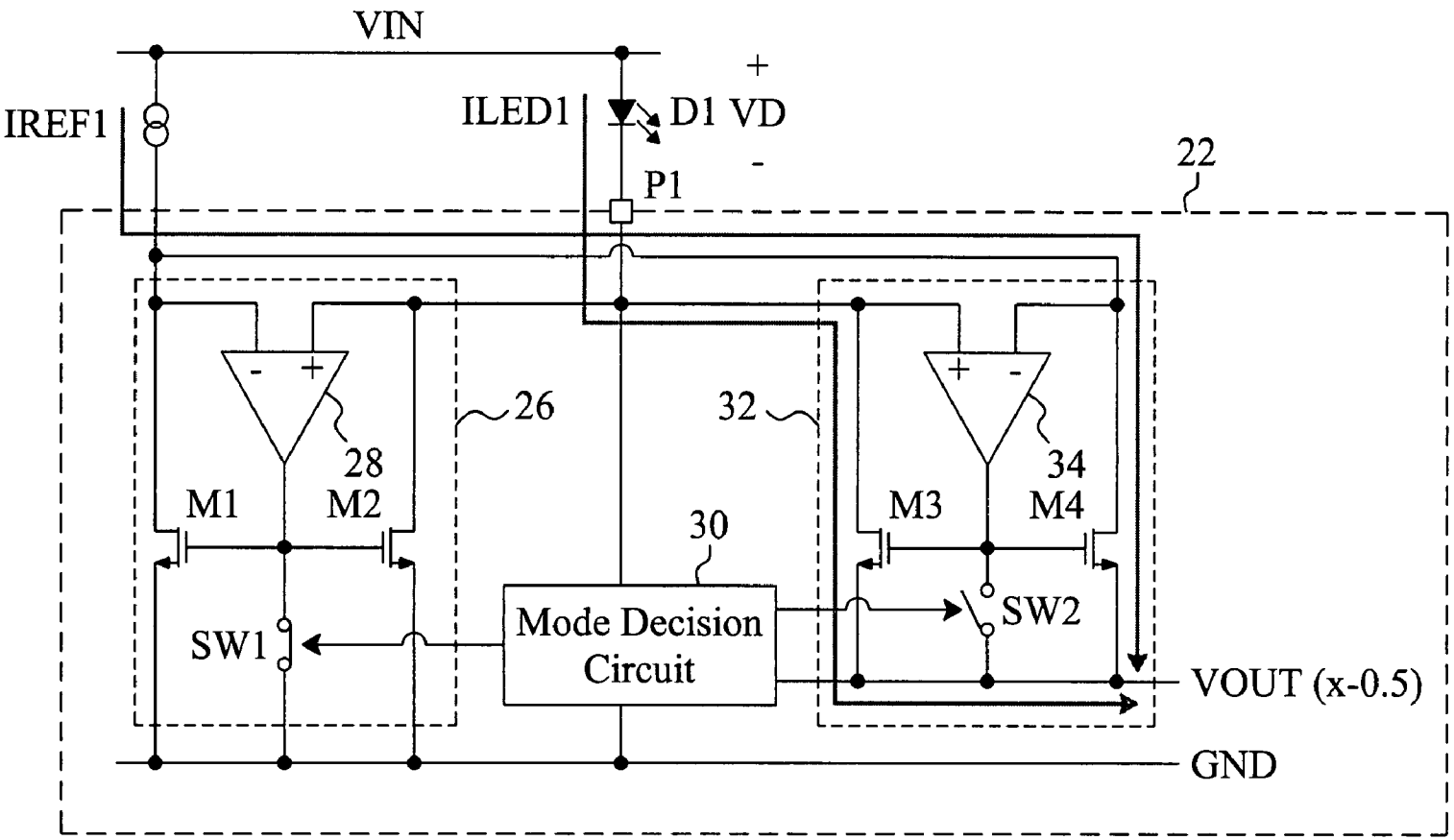
FIG. 5 is a diagram showing the operation of the first embodiment for the current regulator shown in FIG. 3 when the input voltage is lower than a threshold.
Figure 6:
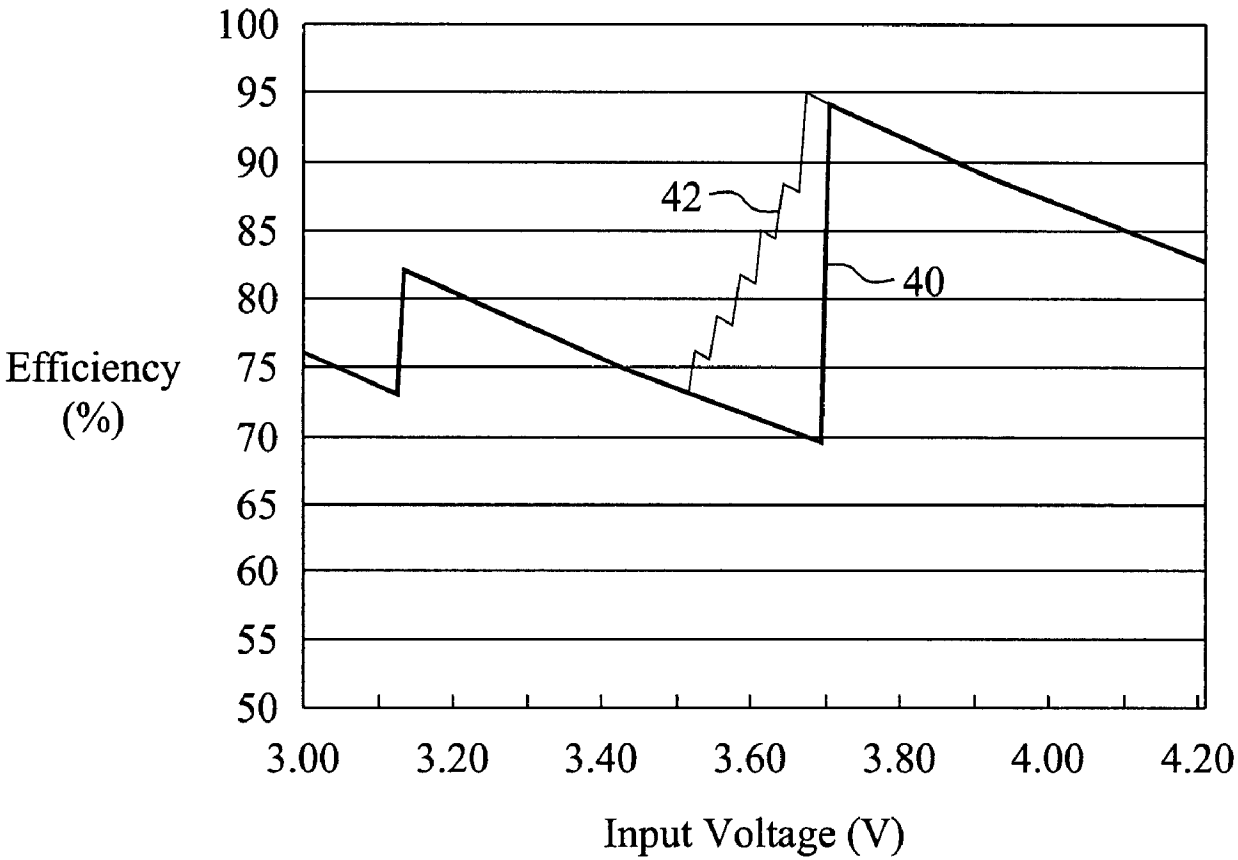
FIG. 6 is a diagram showing a comparison of efficiency between the LED display system shown in FIG. 3 and the conventional LED display system shown in FIG. 1.

FIGS. 4 and 5 are diagrams showing the operation of a first embodiment for the current regulator 22. In the current regulator 22, the mode decision circuit 30 detects the voltage at the node P1 for level detection of the input voltage VIN. When the voltage at the node P1 is not lower than a threshold, the mode decision circuit 30 turns off the switch SW1 to enable the current source 26 and turns on the switch SW2 to disable the current source 32, as shown in FIG. 4. In this case, the current source 26 is responsible for the driving current ILED1 of the LED D1. Contrarily, when the voltage at the node P1 is lower than the threshold, i.e. insufficient input voltage VIN, the mode decision circuit 30 turns on the switch SW1 to disable the current source 26 and turns off the switch SW2 to enable the current source 32, as shown in FIG. 5. In this case, the current source 32 is responsible for the driving current ILED1 of the LED D1. FIG. 6 is a diagram showing a comparison of efficiency between the LED display system 20 and the conventional LED display system 10, in which curve 40 represents the efficiency of the conventional LED display system 10, and curve 42 represents the efficiency of the LED display system 20. In the conventional LED display system 10, if one of the current regulators 16 enters into the mode x1.5, then all the other current regulators 16 also enter into the same mode x1.5; therefore, the efficiency of the conventional LED display system 10 drops abruptly as shown by the curve 40. Whereas in the LED display system 20, each of the current regulators 22 determines by itself whether or not to switch from the mode x1 to the mode x-0.5, and the efficiency of the LED display system 20 decreases slower with the decreasing input voltage VIN, as shown by the curve 42. Hence, the LED display system 20 has higher efficiency.

Figure 7:
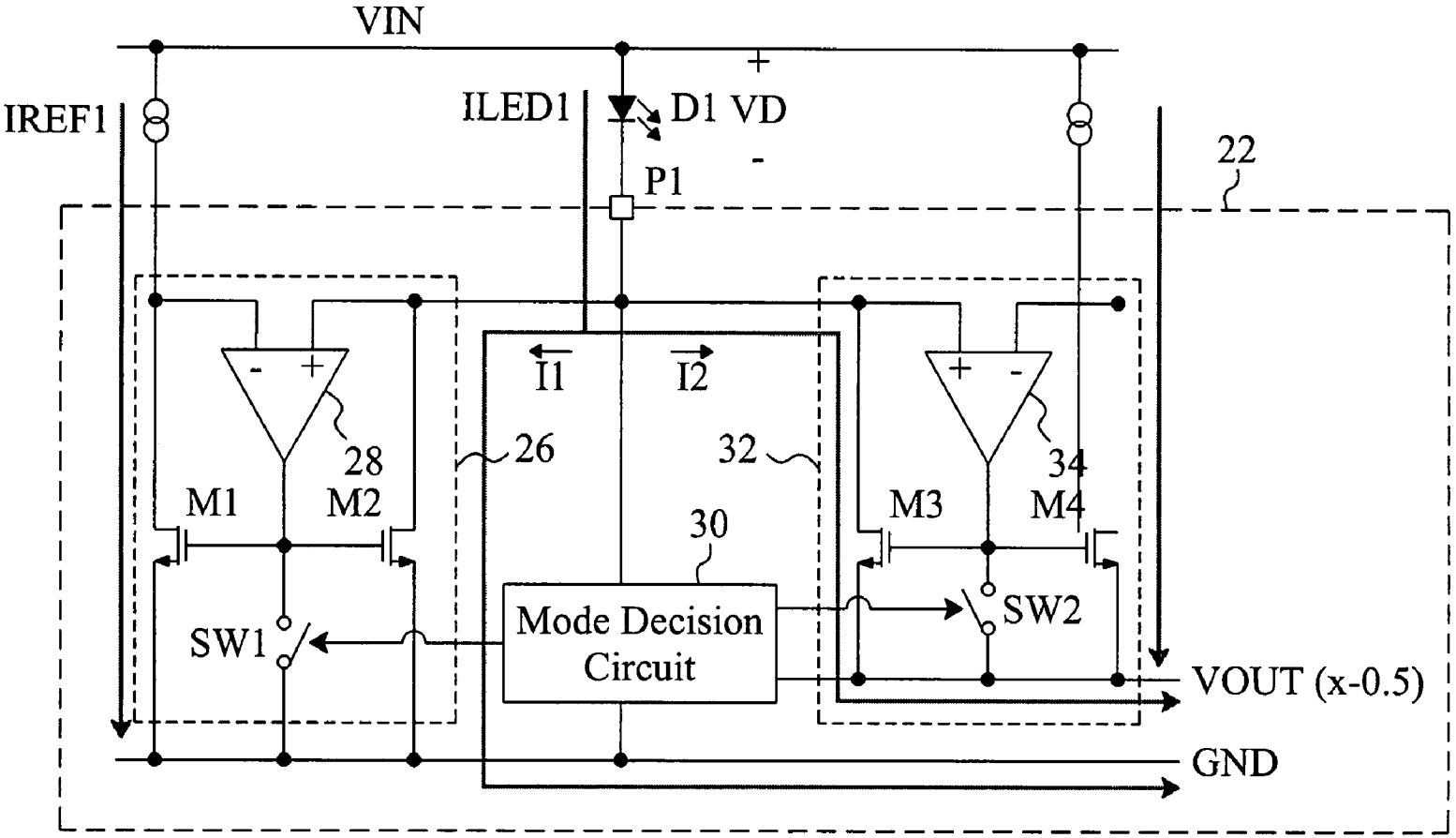
FIG. 7 is a diagram showing the operation of a second embodiment for the current regulator shown in FIG. 3.

FIG. 7 is a diagram showing the operation of a second embodiment for the current regulator 22. When the voltage at the node P1 is higher than a threshold, the mode decision circuit 30 turns off the switch SW1 to enable the current source 26 and turns on the switch SW2 to disable the current source 32. In this case, the current source 26 is responsible for the driving current ILED1 of the LED D1. Contrarily, when the voltage at the node P1 is lower than the threshold, the mode decision circuit 30 enables both the current sources 26 and 32 by turning off the switches SW1 and SW2, as shown in FIG. 7, so that the current source 26 supplies a current I1 and the current source 32 supplies a current I2, resulting in a total current ILED1=I1+I2 for the LED D1. As the input voltage VIN decreases, the current I1 supplied by the current source 26 decreases while the current I2 supplied by the current source 32 increases. Eventually, the driving current ILED1 for the LED D1 is equal to the current I2.

Figure 8:
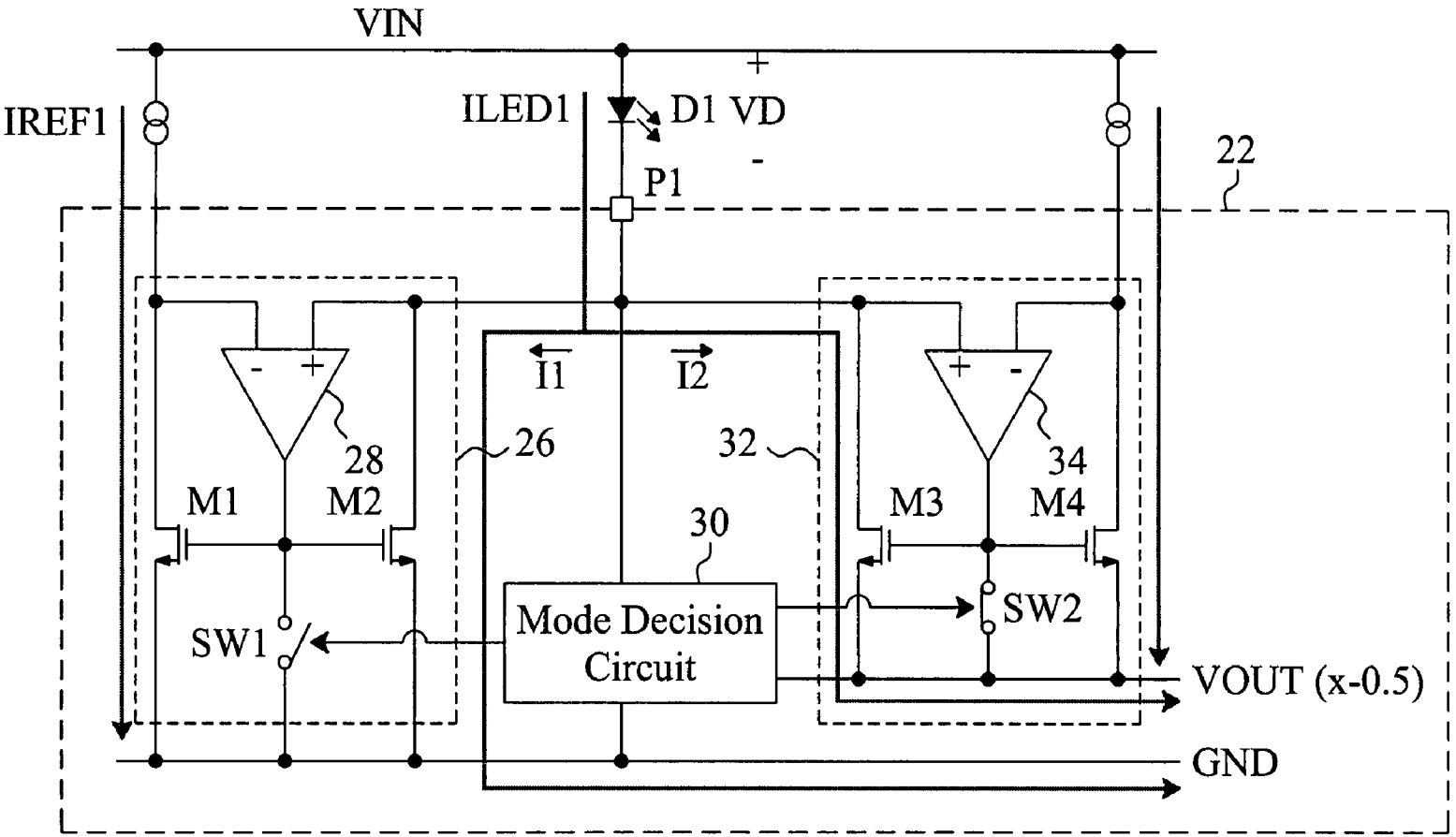
FIG. 8 is a diagram showing the operation of a third embodiment for the current regulator shown in FIG. 3.
Figure 9:
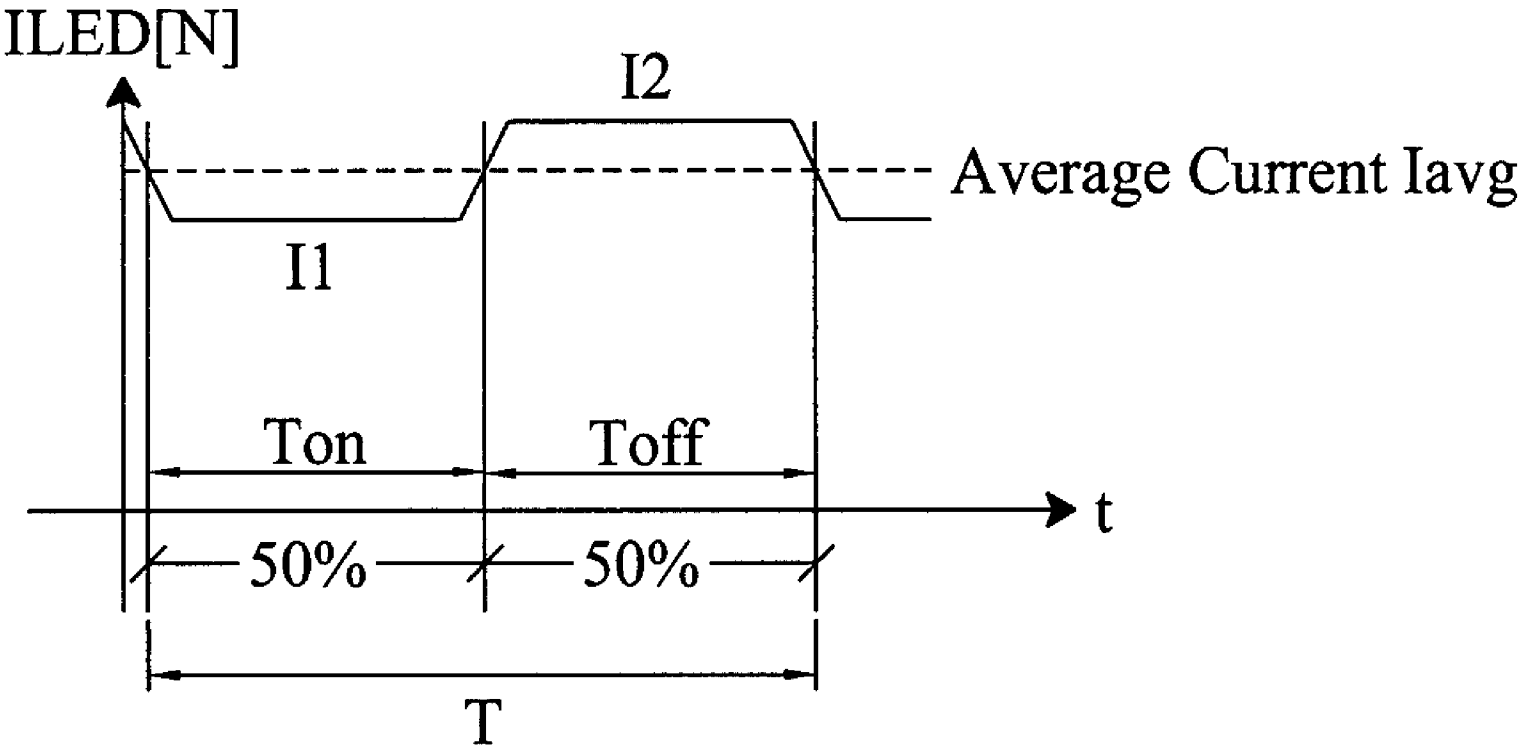
FIG. 9 is a waveform diagram of the driving current in the circuit of FIG. 8.

FIG. 8 is a diagram showing the operation of a third embodiment for the current regulator 22. When the voltage at the node P1 is higher than a threshold, the mode decision circuit 30 turns off the switch SW1 to enable the current source 26 and turns on the switch SW2 to disable the current source 32. In this case, the current source 26 is responsible for the driving current ILED1 of the LED D1. When the voltage at the node P1 is lower than the threshold, the mode decision circuit 30 provides a control signal to alternatively enable the current sources 26 and 32. FIG. 9 is a waveform diagram of the driving current ILED1 in the circuit of FIG. 8, assuming that the control signal has a period T. During the on-time Ton of the control signal, the current source 26 is enabled and thus the driving current ILED1 is equal to the current I1; during the off-time Toff of the control signal, the current source 32 is enabled and thus the driving current ILED1 is equal to the current I2. In this embodiment, the control signal has the duty 50%, i.e., either the on-time Ton or the off-time Toff is 50% of the period T, resulting in the average current $$I\text{avg}=(I1/2)+(I2/2). \quad \text{[Eq-1]}$$

The duty of the control signal, i.e. the on-time Ton and the off-time Toff, will vary with the input voltage VIN.

Figure 10:
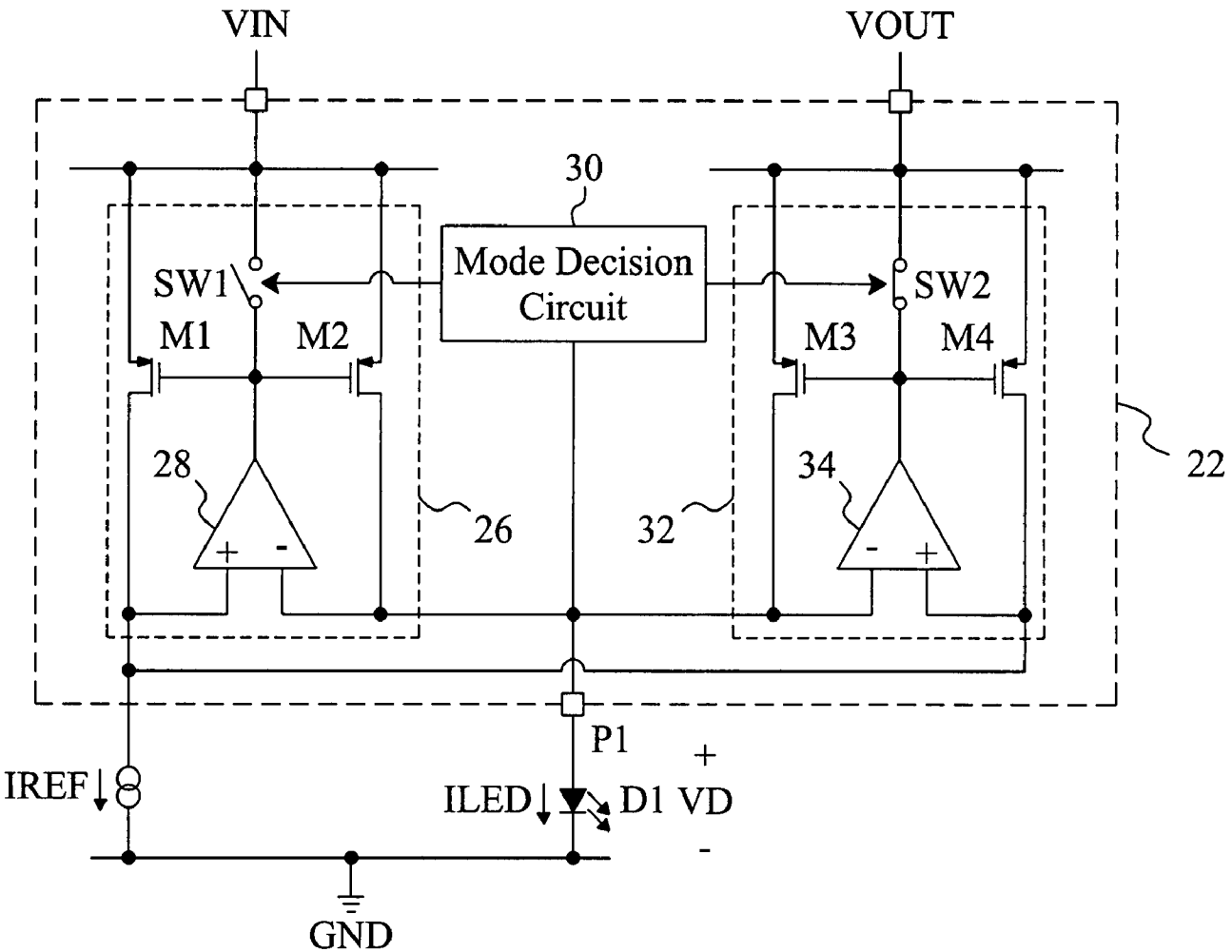
FIG. 10 is a circuit diagram of another embodiment for the current regulator shown in FIG. 3.

FIG. 10 is a circuit diagram of another embodiment for the current regulator 22 shown in FIG. 3, in which the node P1 is connected to the anode of the LED D1, a current source 26 is connected between the voltage input terminal VIN of the charge pump 24 and the node P1, a current source 32 is connected between the voltage output terminal VOUT of the charge pump 24 and the node P1, and the mode decision circuit 30 is configured to detect the voltage at the node P1 to determine whether to enable the current sources 26 and 32. The current source 26 includes an operational amplifier 28, transistors M1 and M2, and a switch SW1. The transistor M1 is connected between the voltage input terminal VIN and the non-inverting input terminal of the operational amplifier 28, and the transistor M2 is connected between the voltage input terminal VIN and the inverting input terminal of the operational amplifier 28. The operational amplifier 28 has an output connected to the gates of the transistors M1 and M2. The switch SW1 is connected between the output terminal of the operational amplifier 28 and the voltage input terminal VIN and is controlled by the mode decision circuit 30. The current source 32 includes an operational amplifier 34, transistors M3 and M4, and a switch SW2. The transistor M3 is connected between the voltage output terminal VOUT and the inverting input terminal of the operational amplifier 34, and the transistor M4 is connected between the voltage output terminal VOUT and the non-inverting input terminal of the operational amplifier 34. The operational amplifier 34 has an output connected to the gates of the transistors M3 and M4. The switch SW2 is connected between the output terminal of the operational amplifier 34 and the voltage output terminal VOUT and is controlled by the mode decision circuit 30. When the voltage at the node P1 is higher than a threshold, the mode decision circuit 30 enables the current source 26 and disables the current source 32. Contrarily, when the voltage at the node P1 is lower than the threshold, the mode decision circuit 30 may disable the current source 26 and enable the current source 32, or enable both the current sources 26 and 32, or alternatively enable the current sources 26 and 32, as illustrated by the aforementioned operations.

Figure 11:
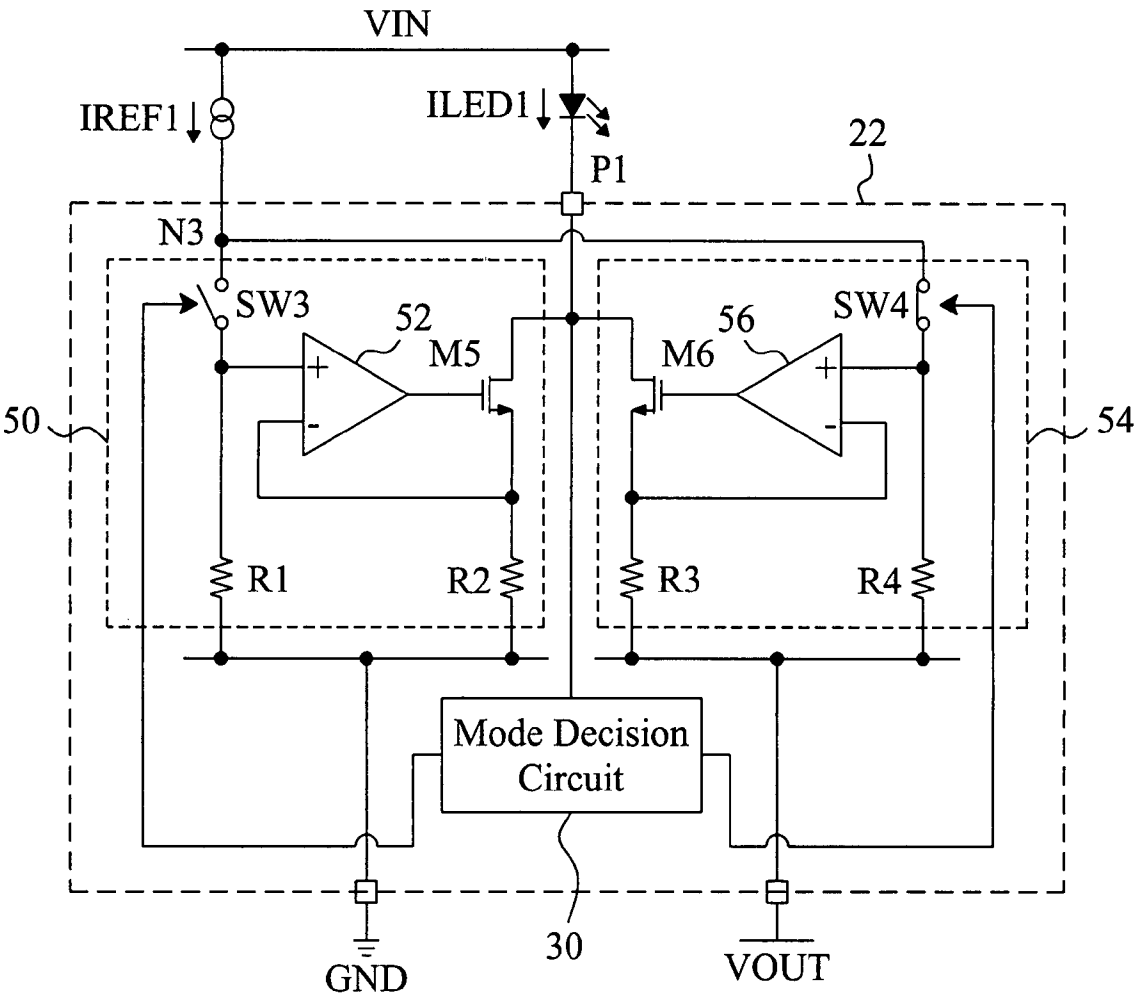
FIG. 11 is a circuit diagram of yet another embodiment for the current regulator shown in FIG. 3.

FIG. 11 is a circuit diagram of yet another embodiment of the current regulator 22 shown in FIG. 3, in which a current source 50 is connected between the node P1 and the ground terminal GND, a current source 54 is connected between the node P1 and the voltage output terminal VOUT of the charge pump 24, and the mode decision circuit 30 is configured to detect the voltage at the node P1 to determine whether to enable the current sources 50 and 54. The current source 50 includes an operational amplifier 52, a switch SW3, a transistor M5, and resistors R1 and R2. The switch SW3 is connected between a node N3 and the non-inverting input terminal of the operational amplifier 52 and is controlled by the mode decision circuit 30. The transistor M5 is connected between the node P1 and the inverting input terminal of the operational amplifier 52. The operational amplifier 52 has an output connected to the gate of the transistor M5. The resistor R1 is connected between the non-inverting input terminal of the operational amplifier 52 and the ground terminal GND, and the resistor R2 is connected between the inverting input terminal of the operational amplifier 52 and the ground terminal GND. The current source 54 includes an operational amplifier 56, a switch SW4, a transistor M6, and resistors R3 and R4. The switch SW4 is connected between the node N3 and the non-inverting input terminal of the operational amplifier 56 and is controlled by the mode decision circuit 30. The transistor M6 is connected between the node P1 and the inverting input terminal of the operational amplifier 56. The operational amplifier 56 has an output connected to the gate of the transistor M6. The resistor R3 is connected between the inverting input terminal of the operational amplifier 56 and the voltage output terminal VOUT of the charge pump 24, and the resistor R4 is connected between the non-inverting input terminal of the operational amplifier 56 and the voltage output terminal VOUT of the charge pump 24.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A current regulator for efficiency improvement of a LED display system including a charge pump and a LED connected between a voltage input terminal of the charge pump and a node, the current regulator comprising:

a first current source connected between the node and a ground terminal;

a second current source connected between the node and a voltage output terminal of the charge pump; and a mode decision circuit connected to the first and second current sources to enable at least one of the first and second current sources for establishing a driving current for the LED.

2. The current regulator of claim 1, wherein the mode decision circuit detects a voltage at the node to enable at least one of the first and second current sources.

3. The current regulator of claim 1, wherein the mode decision circuit enables the first current source sole when a voltage at the node is higher than a threshold, and enables the second current source sole when the voltage at the node is lower than the threshold.

4. The current regulator of claim 1, wherein the mode decision circuit enables the first current source sole when a voltage at the node is higher than a threshold, and enables both the first and second current sources when the voltage at the node is lower than the threshold.

5. The current regulator of claim 1, wherein the mode decision circuit enables the first current source sole when a voltage at the node is higher than a threshold, and provides a control signal to alternatively enable the first and second current sources when the voltage at the node is lower than the threshold.

6. The current regulator of claim 5, wherein the control signal has an on-time during which the first current source is enabled and an off-time during which the second current source is enabled.

7. A current regulator for efficiency improvement of a LED display system including a charge pump and a LED connected between a ground terminal and a node, the current regulator comprising:

a first current source connected between the node and a voltage input terminal of the charge pump;

a second current source connected between the node and a voltage output terminal of the charge pump; and a mode decision circuit connected to the first and second current sources to enable at least one of the first and second current sources for establishing a driving current for the LED.

8. The current regulator of claim 7, wherein the mode decision circuit detects a voltage at the node to enable at least one of the first and second current sources.

9. The current regulator of claim 7, wherein the mode decision circuit enables the first current source sole when a voltage at the node is higher than a threshold, and enables the second current source sole when the voltage at the node is lower than the threshold.

10. The current regulator of claim 7, wherein the mode decision circuit enables the first current source sole when a voltage at the node is higher than a threshold, and enables both the first and second current sources when the voltage at the node is lower than the threshold.

11. The current regulator of claim 7, wherein the mode decision circuit enables the first current source sole when a voltage at the node is higher than a threshold, and provides a control signal to alternatively enable the first and second current sources when the voltage at the node is lower than the threshold.

12. The current regulator of claim 11, wherein the control signal has an on-time during which the first current source is enabled and an off-time during which the second current source is enabled.

13. A method for efficiency improvement of a LED display system including a charge pump and a LED connected between a voltage input terminal of the charge pump and a node, the method comprising the steps of:

detecting a voltage at the node; and according to the voltage at the node, enabling at least one of a first current source connected between the node and a ground terminal and a second current source connected between the node and a voltage output terminal of the charge pump, for establishing a driving current for the LED.

14. The method of claim 13, wherein the first current source is enabled sole when the voltage at the node is higher than a threshold, and the second current source is enabled sole when the voltage at the node is lower than the threshold.

15. The method of claim 13, wherein the first current source is enabled sole when the voltage at the node is higher than a threshold, and both the first and second current sources are enabled when the voltage at the node is lower than the threshold.

16. The method of claim 13, wherein the first current source is enabled sole when the voltage at the node is higher than a threshold, and the first and second current sources are alternatively enabled by a control signal when the voltage at the node is lower than the threshold.

17. The method of claim 16, wherein the control signal has an on-time during which the first current source is enabled and an off-time during which the second current source is enabled.

18. A method for efficiency improvement of a LED display system including a charge pump and a LED connected between a node and a ground terminal, the method comprising the steps of:

detecting a voltage at the node; and according to the voltage at the node, enabling at least one of a first current source connected between a voltage input terminal of the charge pump and the node and a second current source connected between a voltage output terminal of the charge pump, for establishing a driving current for the LED.

19. The method of claim 18, wherein the first current source is enabled sole when the voltage at the node is higher than a threshold, and the second current source is enabled sole when the voltage at the node is lower than the threshold.

20. The method of claim 18, the first current source is enabled sole when the voltage at the node is higher than a threshold, and both the first and second current sources are enabled when the voltage at the node is lower than the threshold.

21. The method of claim 18, wherein the first current source is enabled sole when the voltage at the node is higher than a threshold, and the first and second current sources are alternatively enabled by a control signal when the voltage at the node is lower than the threshold.

22. The method of claim 21, wherein the control signal has an on-time during which the first current source is enabled and an off-time during which the second current source is enabled.

* * * * *